United States Patent [19]

Morris

[11] Patent Number: 4,556,335

[45] Date of Patent: Dec. 3, 1985

[54] PRINT WHEEL MOUNTING MEANS

[75] Inventor: Lyle E. Morris, San Ramon, Calif.

[73] Assignee: Xerox Corporation, Stamford, Conn.

[21] Appl. No.: 610,546

[22] Filed: May 14, 1984

[51] Int. Cl.[4] ..... B41J 1/24; B41J 1/30

[52] U.S. Cl. ..... 400/144.2; 400/175; 101/93.19

[58] Field of Search ..... 400/174, 175, 144.2, 400/144.3, 144.1, 144, 140, 139; 101/93.18, 93.19, 93.20

[56] References Cited

U.S. PATENT DOCUMENTS

| | | | |
|---|---|---|---|
| 3,878,929 | 4/1975 | Orlens et al. | 197/53 |
| 4,049,110 | 9/1977 | Frechette | 400/175 |
| 4,314,770 | 2/1982 | Harre | 400/175 |
| 4,363,559 | 12/1982 | Suzuki et al. | 400/175 |

FOREIGN PATENT DOCUMENTS

| | | | |
|---|---|---|---|
| 0038691 | 10/1981 | European Pat. Off. | 400/175 |
| 2806277 | 8/1979 | Fed. Rep. of Germany | 400/144.2 |
| 2902544 | 8/1980 | Fed. Rep. of Germany | 400/144.2 |
| 0144969 | 11/1981 | Japan | 400/175 |
| 2022022 | 12/1979 | United Kingdom | 400/144.2 |

*Primary Examiner*—Edgar S. Burr
*Assistant Examiner*—James R. McDaniel
*Attorney, Agent, or Firm*—Richard A. Tomlin

[57] ABSTRACT

A print wheel mounting means. The print wheel has pivot posts formed integrally thereon. The pivot posts are spring-locked into channels in a connector attached to the print wheel drive shaft. The connector thus positions the print wheel to be pivoted onto the print wheel drive shaft.

2 Claims, 6 Drawing Figures

PRINT WHEEL MOUNTING MEANS

This invention relates to serial printing devices and, more particularly, to high-speed serial printers having print fonts arranged upon a disc member, which disc member rotates the fonts past an impacting printing hamber. It is desirable in such devices to provide a print wheel disc that may be readily changed by the operator so that a wide variety of type styles may be conveniently available.

It is also desirable to provide a low-cost print wheel which does not require a cartridge. Where a print wheel cartridge is used, normally a spring is required to bias the print wheel out of contact with the cartridge to allow print wheel rotation. The contact between the spring and the print wheel creates a source of friction loss. It is also desirable to provide a secure, positive mount so that the print wheel is held firmly in place relative to the print wheel drive shaft.

The above advantages and others are obtained by the present invention. One way of carrying out the invention is described below with reference to the drawing, which illustrates a single preferred embodiment in which.

Figure 1:
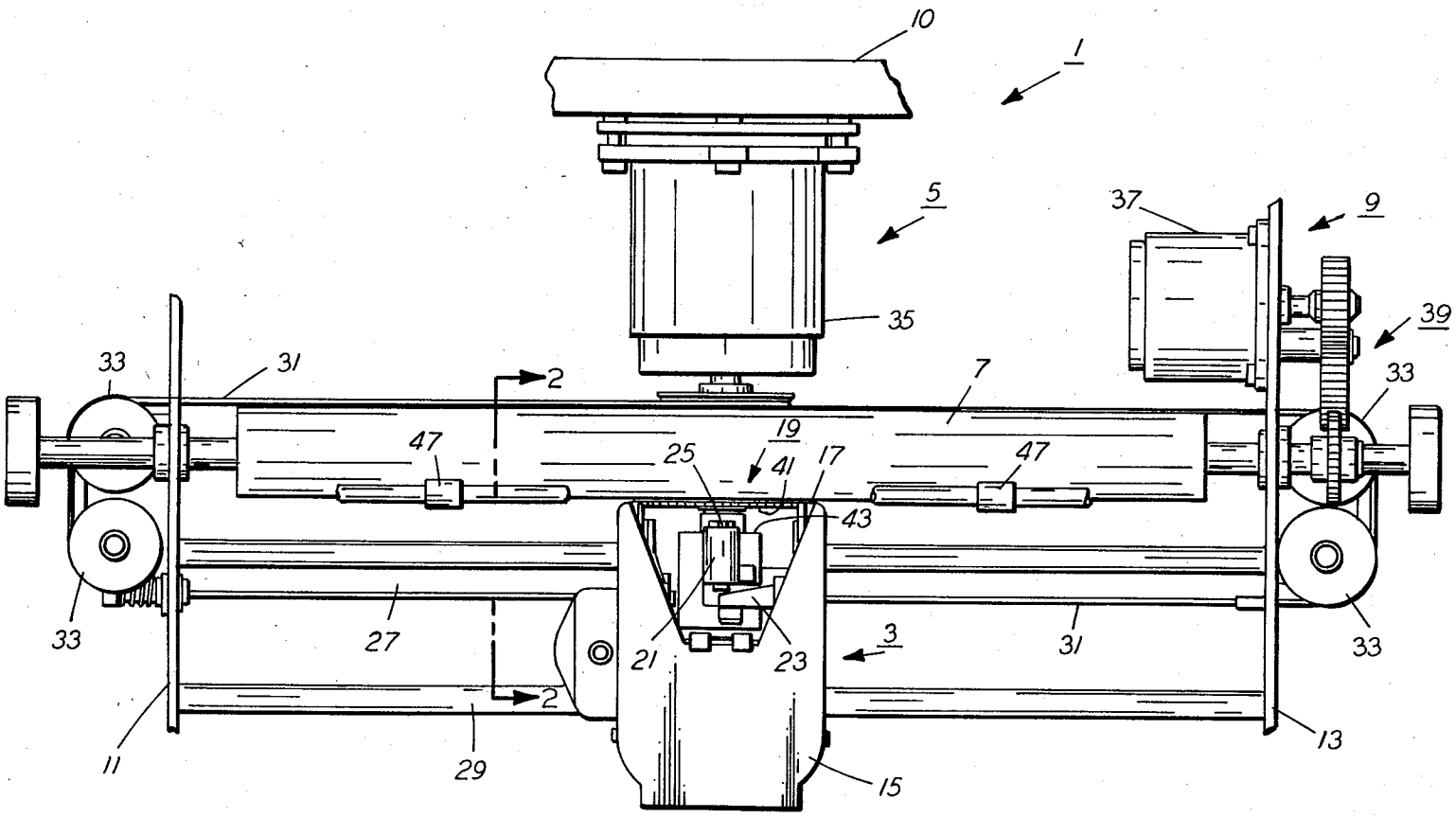
FIG. 1 is a top view of a typical scanning carriage printer in which the print wheel mounting means of the present invention could be used.

Referring now to FIG. 1, there is shown a typical scanning carriage printer designated generally as 1. Scanning carriage printer 1 is made up of a carriage designated generally as 3, a scanning carriage drive mechanism generally designated as 5, a printer platen 7, printer platen drive means designated generally as 9 and a printer frame 10, which includes side members 11 and 13. Scanning carriage 3 includes a ribbon cartridge 15 for providing ink ribbon 17 to a printing station generally designated 19. Also supported on carriage 3 is print hammer mechanism 21 which includes actuator 23 and hammer 25. Carriage 3 is mounted by conventional means on carriage guide rods 27 and 29. Carriage 3 also carries a print wheel 41 and print wheel drive motor 43. Guide rods 27 and 29 are supported by side members 11 and 13. A cable 31 is connected to carriage 3. By means of pulleys 33 and carriage drive motor 35, carriage 3 can be caused to scan across printer platen 7 as is well known in the art. Printer platen drive means 9 includes platen drive motor 37 and connecting gears generally designated 39. Printer platen 7 is mounted for rotation in side member 11 and 13 and driven by connecting gears 39.

Figure 2:
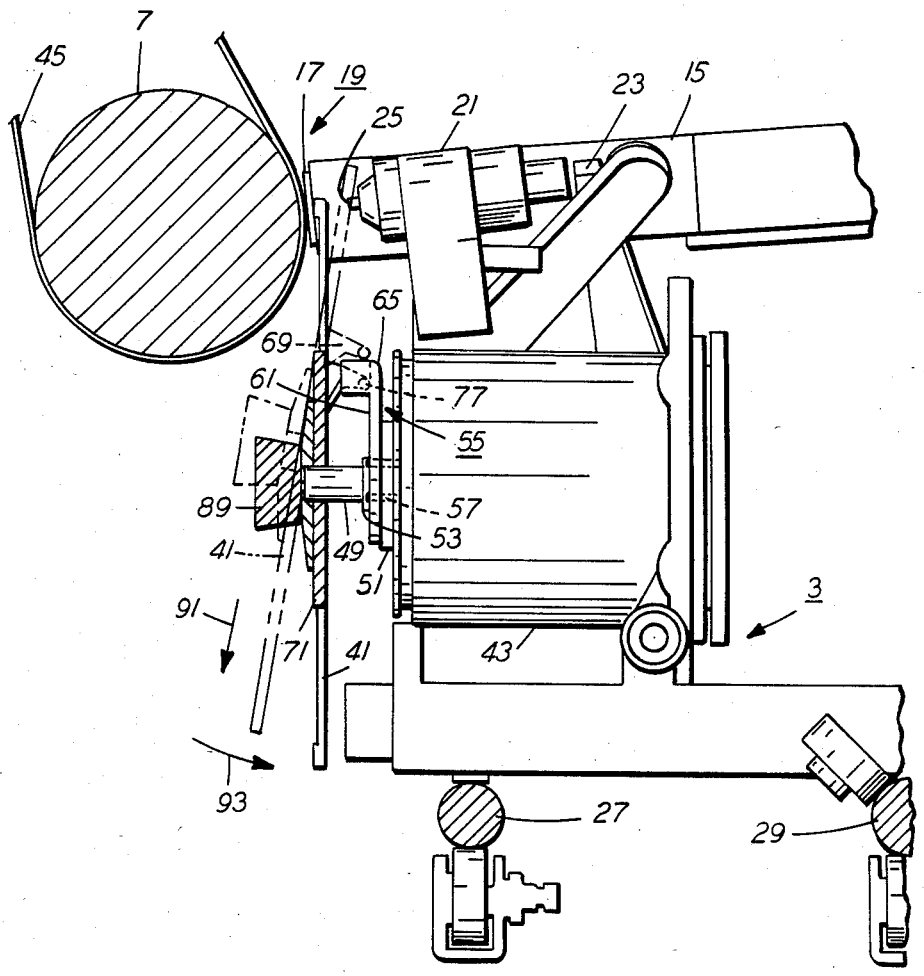
FIG. 2 is a side view taken along line 2—2 in FIG. 1.
Figure 3:
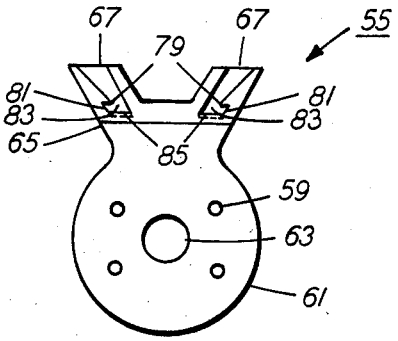
FIG. 3 is a plan view of the print wheel to drive shaft connector as seen from the print wheel side.
Figure 4:
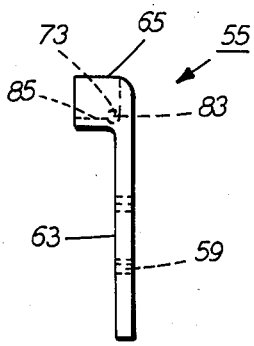
FIG. 4 is a side view of the print wheel to drive shaft connector of FIG. 3.
Figure 5:
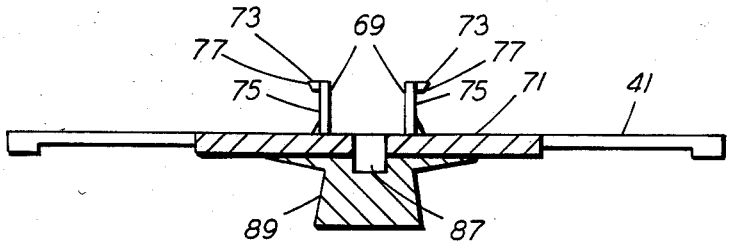
FIG. 5 is a top sectional view of a print wheel in accordance with this invention.
Figure 6:
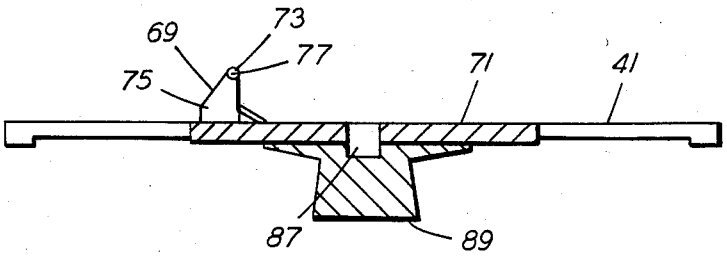
FIG. 6 is a side sectional view of the print wheel of FIG. 5.

Referring now to FIG. 2, there is shown an enlarged side sectional view of the printer 1 of FIG. 1 without the platen and carriage drive mechanisms 9, 5, respectively, being shown. Also, only a portion of the ribbon cartridge 15 is shown so that the print hammer 21 and associated elements may be seen. Platen 7 has, for example, paper 45 held against its perimeter by bails 47 (see FIG. 1).

Referring now to FIGS. 2–6, print wheel drive motor 43 is provided with a print wheel drive shaft 49. Print wheel drive shaft 49 is provided with a face plate 51 and an enlarged diameter section 53 on which print wheel connector designated generally as 55 is mounted. Print wheel connector 55 is fastened to face plate 51 by means of screws 57, which traverse print wheel connector 55 through holes 59. As print wheel drive shaft 49 rotates, print wheel connector 55 rotates with it. Print wheel connector 55 has a lower part 61, which includes aperture 63, for mounting on print wheel drive shaft enlarged diameter section 53 and an upper section 65, which includes means for retaining print wheel 41.

Referring more specifically to FIGS. 3–6, upper section 65 of print wheel connector 55 is provided with deep grooves 67, which are shaped and sized to guide print wheel fasteners 69 into the print wheel lock position. Print wheel fasteners 69 formed on print wheel hub 71 include pivot posts 73 and flexible pivot post supports 75. Pivot post supports 75 are designed so that as print wheel fasteners 69 slide down grooves 67, they deflect enough to allow the outer edges 77 of pivot posts 73 to slide by projections 79 and snap into place against end walls 81 of channels 83. Channel 83 is provided with a front lip 85 to aid retention of pivot post 73 in channel 83. Print wheel 41 is provided with a bore 87, which is sized to friction fit print wheel drive shaft 49. Print wheel 41 is further provided with a knob 89 to assist operator handling.

Referring to FIG. 2, the method of print wheel 41 insertion and removal can be seen. To insert print wheel 41, print wheel pivot posts 77 are placed in grooves 67. Print wheel 41 is then pushed downward in the direction indicated by arrow 91 until pivot posts 77 are captured in channel 83 (see FIG. 3). Print wheel 41 is then pressed towards print wheel drive shaft 49 in the direction shown by arrow 93 until print wheel 41 is firmly seated on drive shaft 49. The above steps are reversed to remove print wheel 41.

It can be seen that the print wheel mounting apparatus of this invention has the following desirable features. It is a low-cost print wheel and does not require a print wheel cartridge. All of the mounting elements, including pivot posts 77, pivot post supports 75 and bore 87, are all molded in one piece with print wheel 41. Print wheel-to-print wheel cartridge friction is eliminated. Print wheel 41 is exactly centered on print wheel drive shaft 49, and the spring-loaded retention of pivot posts 77 in channels 83 prevents print wheel 41 from rotationally slipping relative to print wheel drive shaft 49. Further, it is not necessary to move any mechanism to install or remove print wheel 41 other than print wheel 41 itself.

Although the present invention has been described with reference to a presently preferred embodiment, it will be appreciated by those skilled in the art that various modifications, alternatives and variations may be made without departing from the spirit and scope of the invention as defined in the appended claims.

What is claimed is:

1. A means for mounting a print wheel for rotation on a print wheel motor drive shaft which comprises:

a connector attached to the motor drive shaft for rotation therewith, said connector including channels;

a print wheel having a bore and print wheel fasteners formed integrally in said print wheel, said print wheel fasteners including pivot posts and flexible pivot post supports, said pivot posts adapted to be spring-locked for pivoting motion in said channels by said flexible pivot post supports, said pivot posts being lockable in said channels with said print wheel bore removed from said drive shaft said pivot posts when locked in said channels defining an axis about which said print wheel can be pivoted to slide said print wheel bore on the said drive shaft frictionally locking said print wheel to the print wheel drive shaft.

2. The means for mounting of claim 1 wherein said connector is provided with grooves for guiding said pivot posts into said channels.

* * * * *